US011209750B2

(12) United States Patent
Moon et al.

(10) Patent No.: US 11,209,750 B2
(45) Date of Patent: Dec. 28, 2021

(54) TONER REFILL CARTRIDGE WITH HOLDER HOLDING MEMORY UNIT THEREON AND ROTATABLE WITH RESPECT TO CARTRIDGE BODY

(71) Applicant: HEWLETT-PACKARD DEVELOPMENT COMPANY, L.P., Spring, TX (US)

(72) Inventors: Ji Won Moon, Suwon (KR); Woong Yong Choi, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,390

(22) PCT Filed: Dec. 21, 2018

(86) PCT No.: PCT/KR2018/016415

§ 371 (c)(1),
(2) Date: Oct. 21, 2020

(87) PCT Pub. No.: WO2020/045763

PCT Pub. Date: Mar. 5, 2020

(65) Prior Publication Data

US 2021/0255565 A1 Aug. 19, 2021

(30) Foreign Application Priority Data

Aug. 30, 2018 (KR) ..... 10-2018-0102559

(51) Int. Cl.
*G03G 15/08* (2006.01)

(52) U.S. Cl.
CPC ..... *G03G 15/0886* (2013.01); *G03G 15/0865* (2013.01); *G03G 15/0894* (2013.01)

(58) Field of Classification Search
CPC ..... G03G 15/0863; G03G 15/0865; G03G 15/0886; G03G 15/0894; G03G 21/1878
USPC ..... 399/120, 252, 258, 260, 262, 263
See application file for complete search history.

(56) References Cited

U.S. PATENT DOCUMENTS

| | | | | |
|---|---|---|---|---|
| 6,862,420 | B1 | 3/2005 | Less | |
| 7,163,032 | B2 * | 1/2007 | Itabashi | G03G 15/0898 141/12 |
| 8,873,996 | B1 * | 10/2014 | Buchanan | G03G 15/0865 399/98 |
| 9,031,425 | B2 | 5/2015 | Mendoza | |
| 9,229,367 | B2 * | 1/2016 | Leemhuis | G03G 15/0865 |
| 9,958,807 | B1 | 5/2018 | Huang | |

(Continued)

FOREIGN PATENT DOCUMENTS

| | | |
|---|---|---|
| JP | 2005092240 | 4/2005 |
| JP | 2006221079 | 8/2006 |
| KR | 1020140080781 | 7/2014 |

*Primary Examiner* — H H Tran
(74) *Attorney, Agent, or Firm* — Trop Pruner & Hu, P.C.

(57) ABSTRACT

Provided is a toner cartridge. The toner cartridge includes a body, a plunger, a memory unit, and a holder. The body is to accommodate toner and includes a toner discharge portion. The plunger is provided in the body and to push the toner outside of the body via the toner discharge portion. The memory unit includes an electrical contact portion including at least one electrical contact point. The holder facilities loading of the memory unit therein and being rotatable relative to the body between a home position and a rotated position.

15 Claims, 10 Drawing Sheets

(56) References Cited

U.S. PATENT DOCUMENTS

| | | | |
|---|---|---|---|
| 2011/0064476 | A1 | 3/2011 | Takiguchi et al. |
| 2011/0064477 | A1 | 3/2011 | Takiguchi et al. |
| 2011/0217067 | A1 | 9/2011 | Tokuno et al. |
| 2014/0227008 | A1 | 8/2014 | Janssen |

* cited by examiner

[Fig. 1]
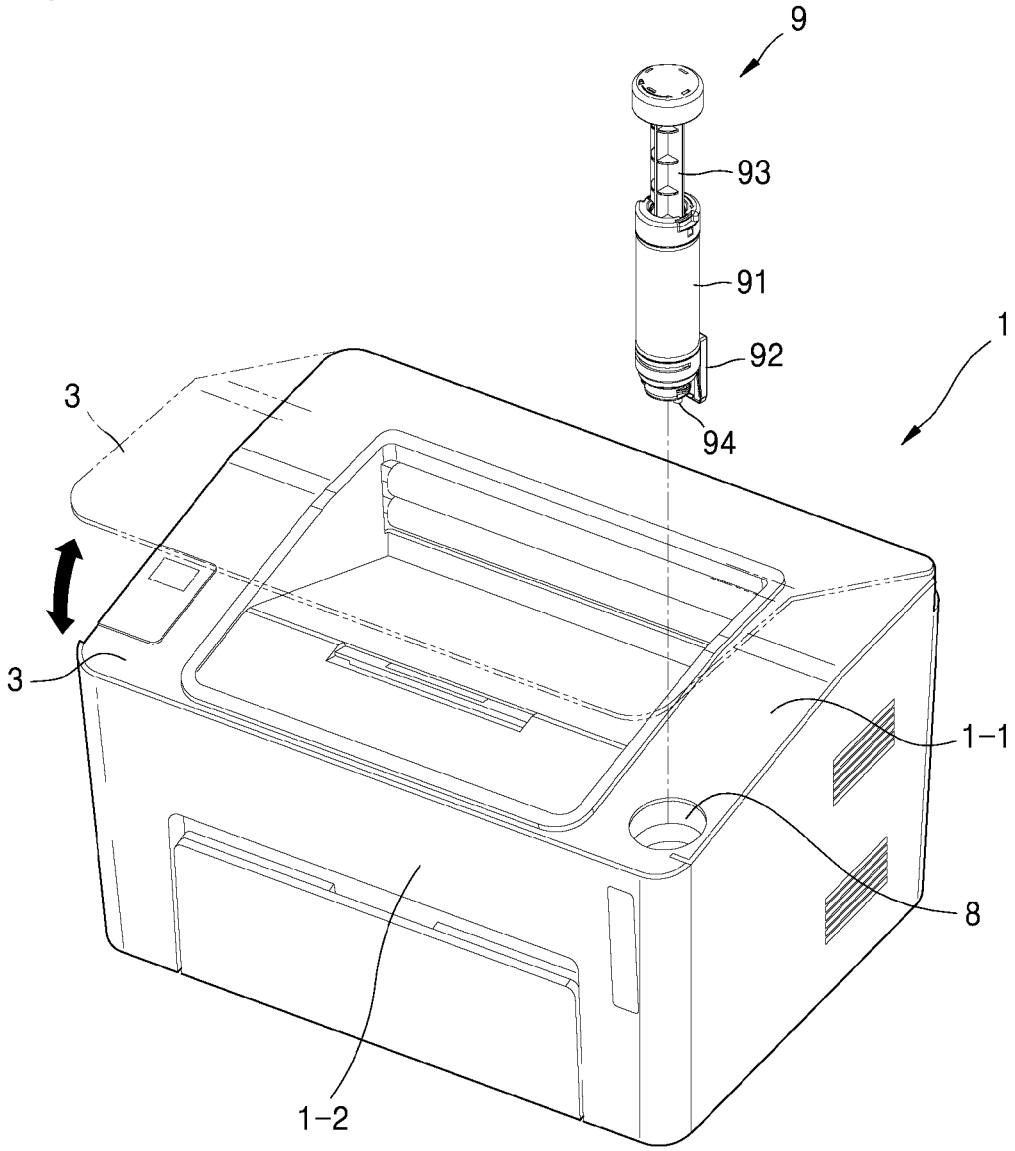

[Fig. 2]
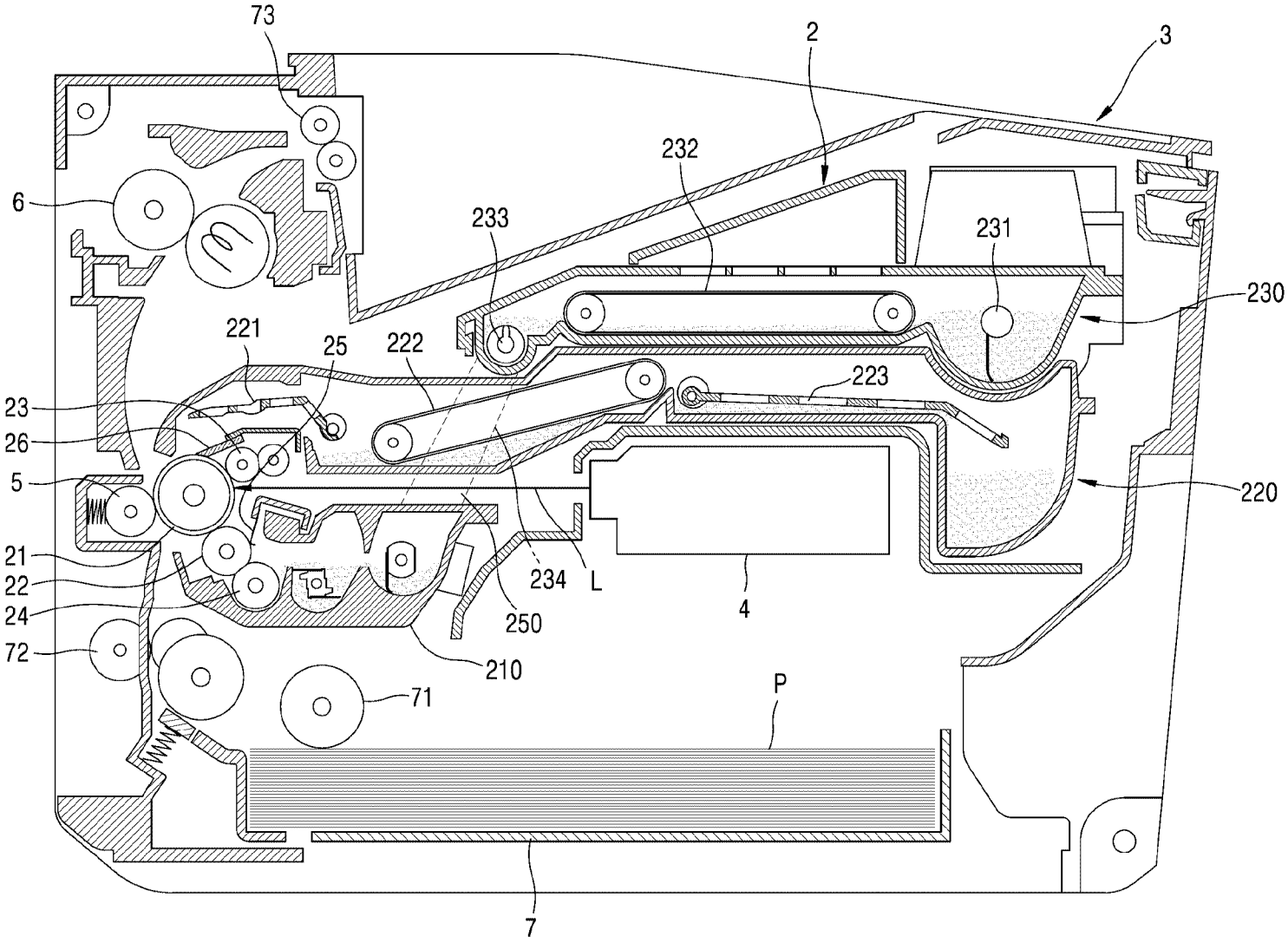

[Fig. 3]
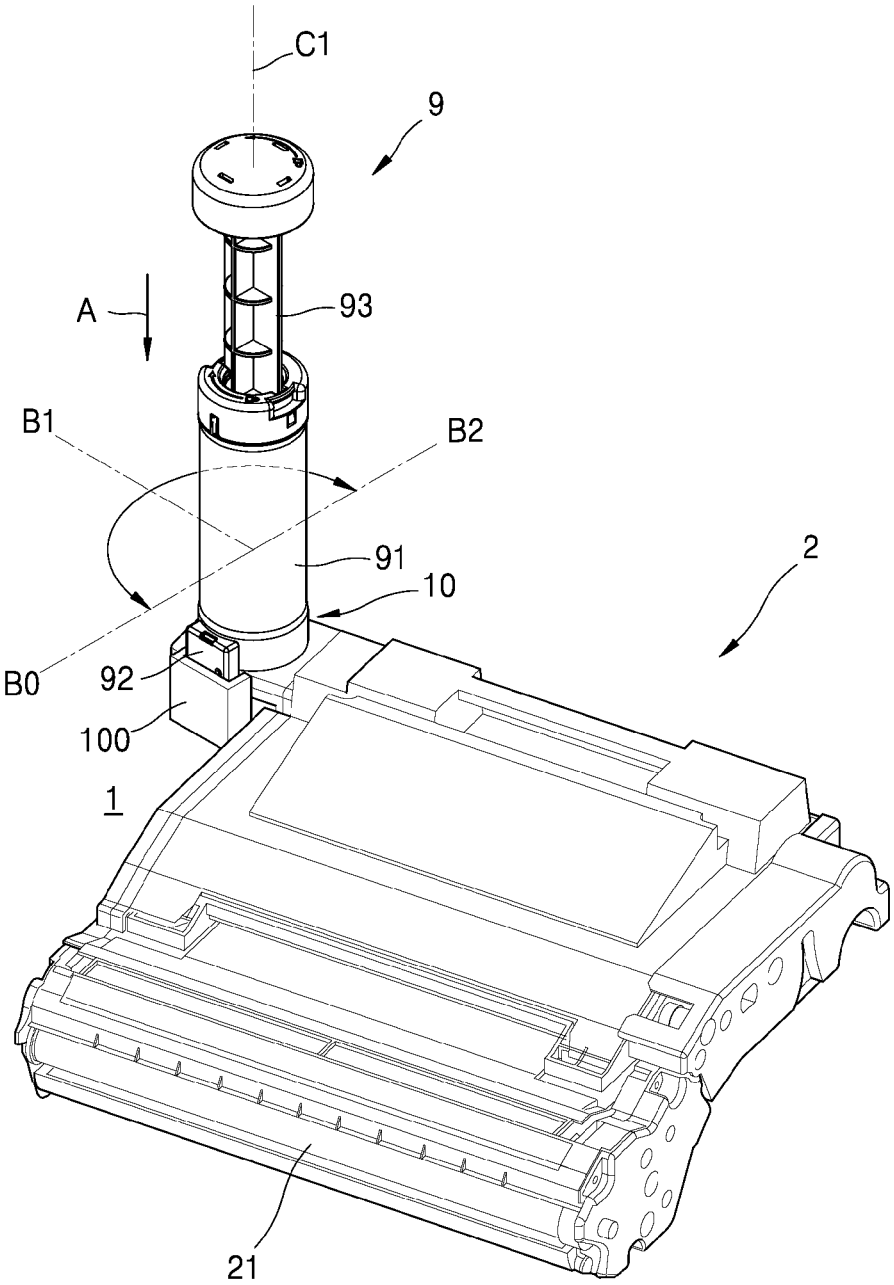

[Fig. 4]
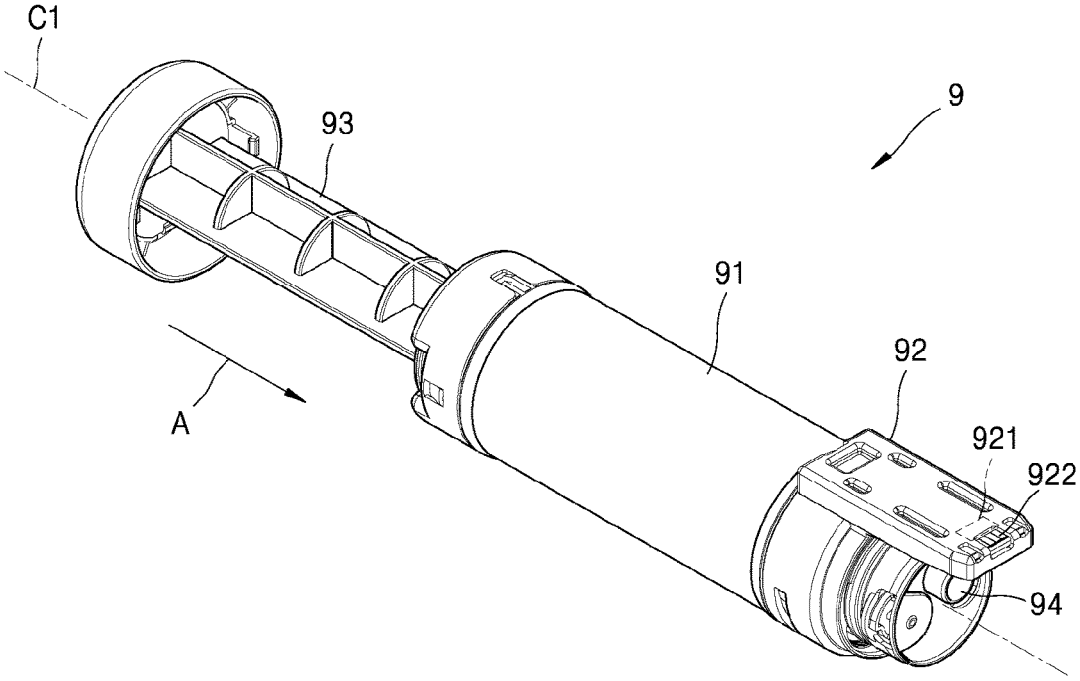

[Fig. 5]
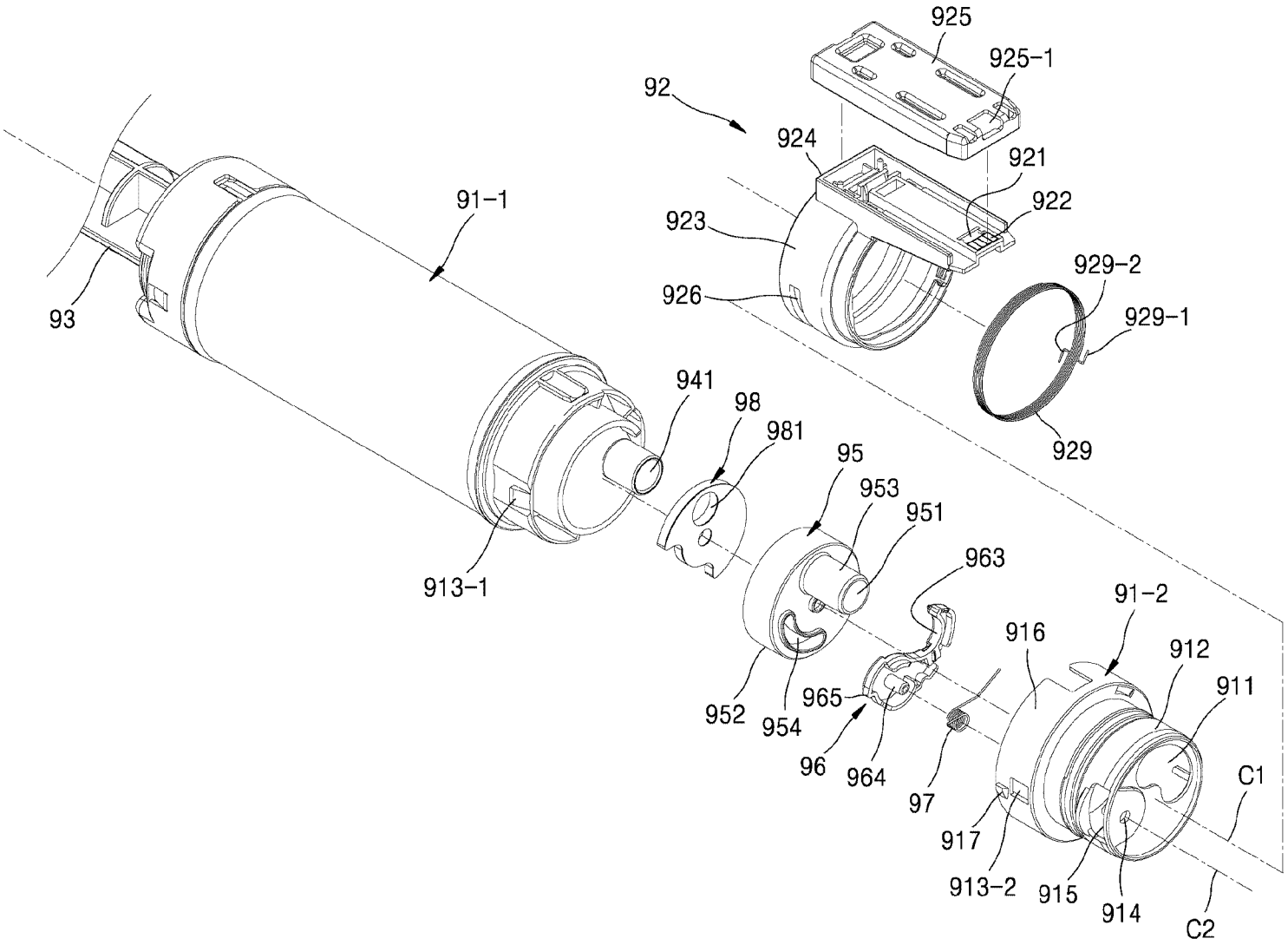

[Fig. 6]
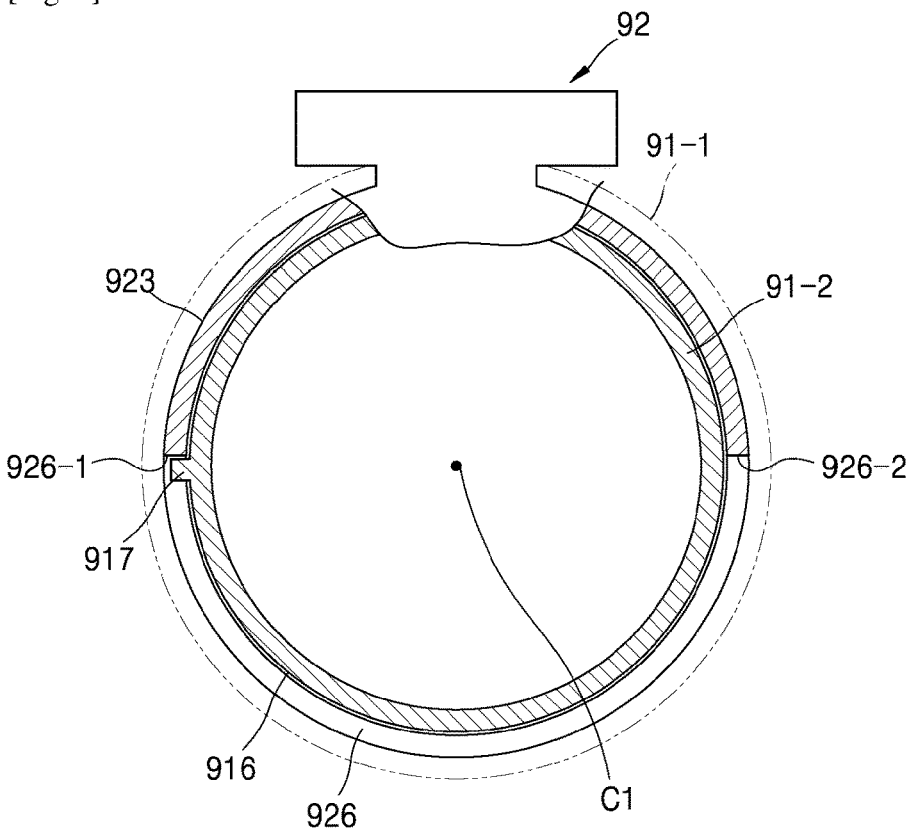
[Fig. 7]
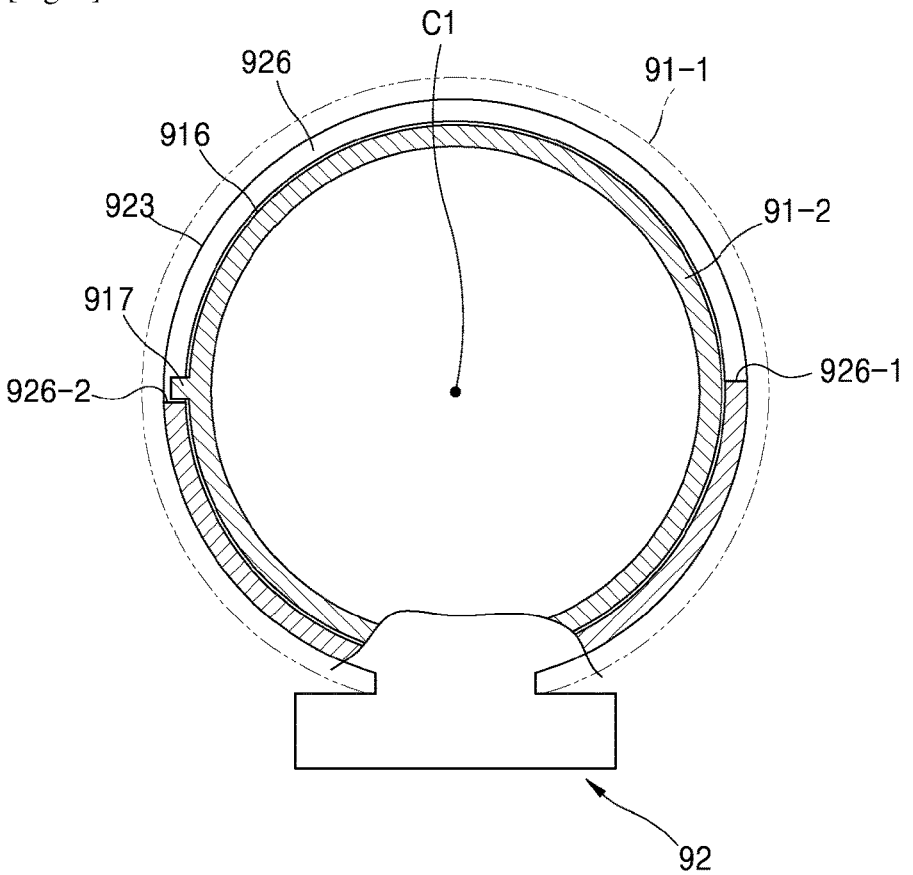

[Fig. 8]
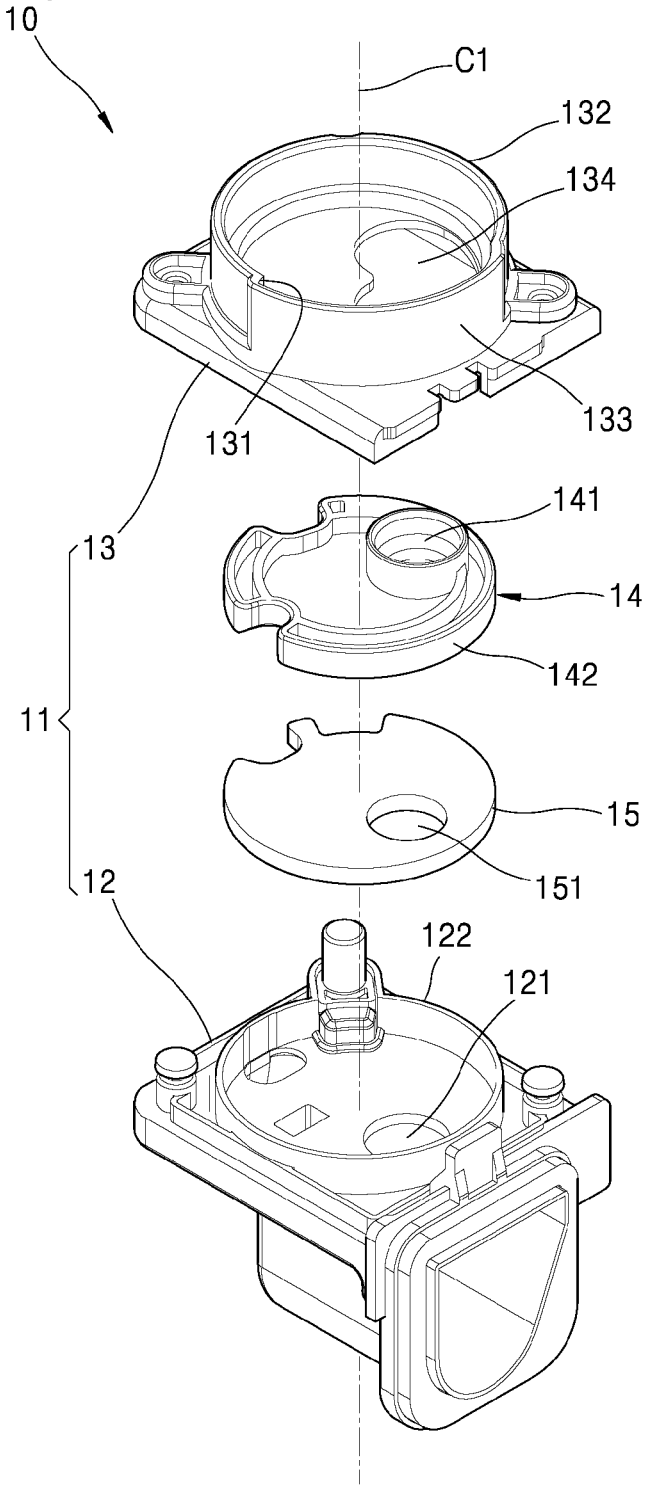

[Fig. 9]
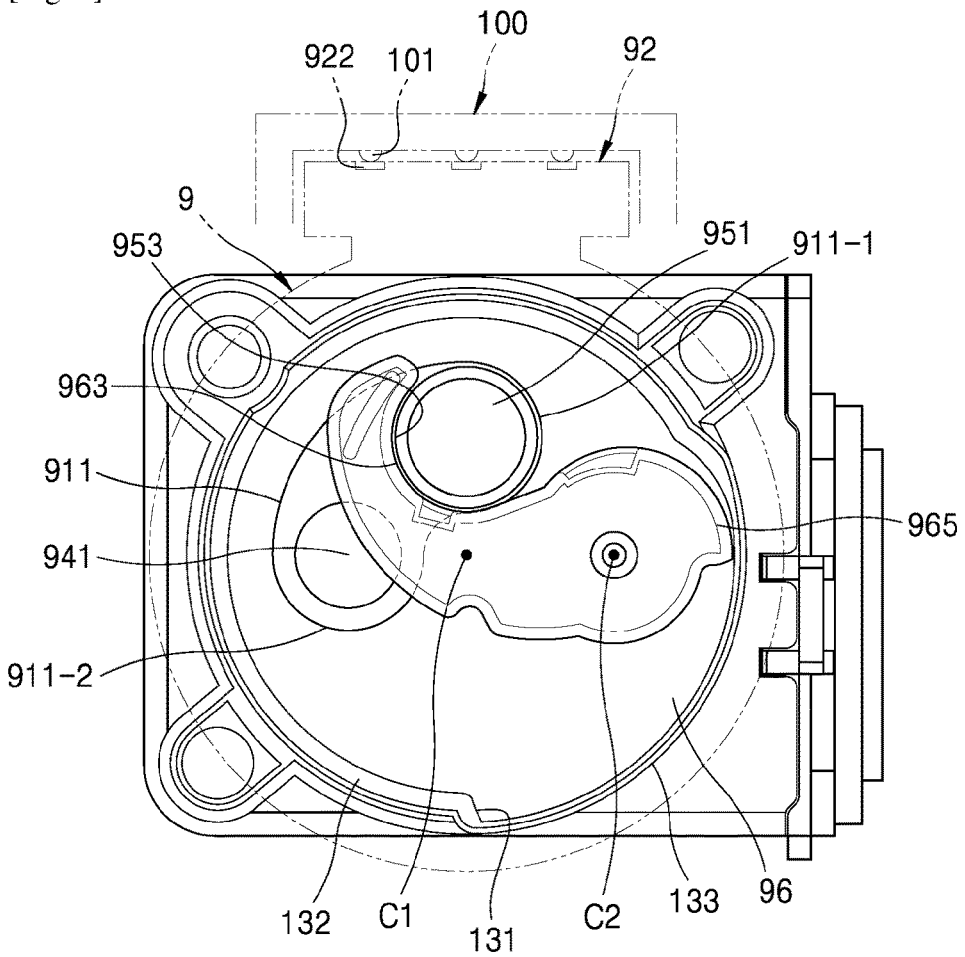
[Fig. 10]
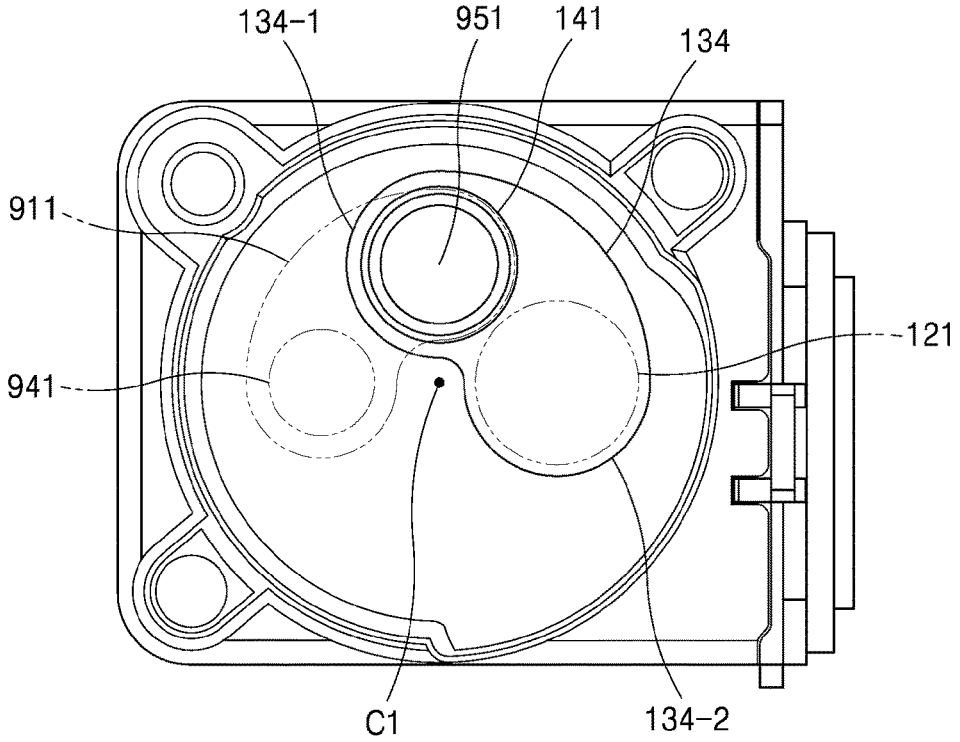

[Fig. 11]
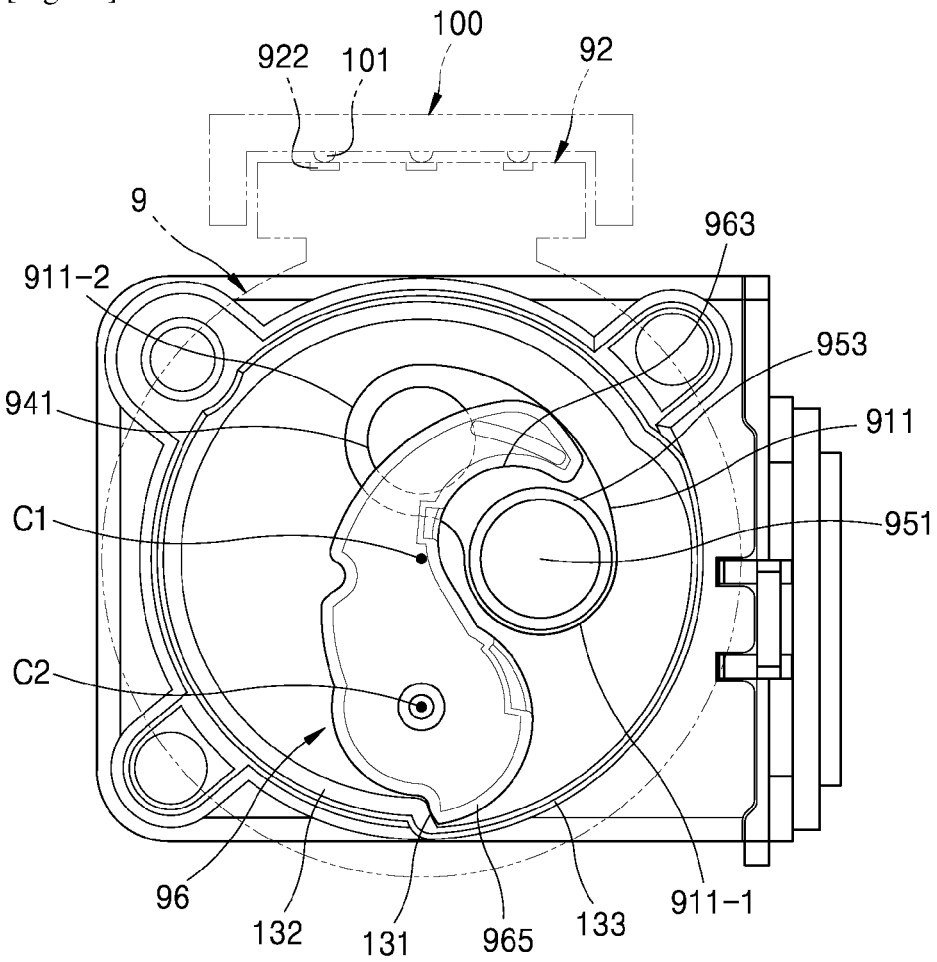
[Fig. 12]
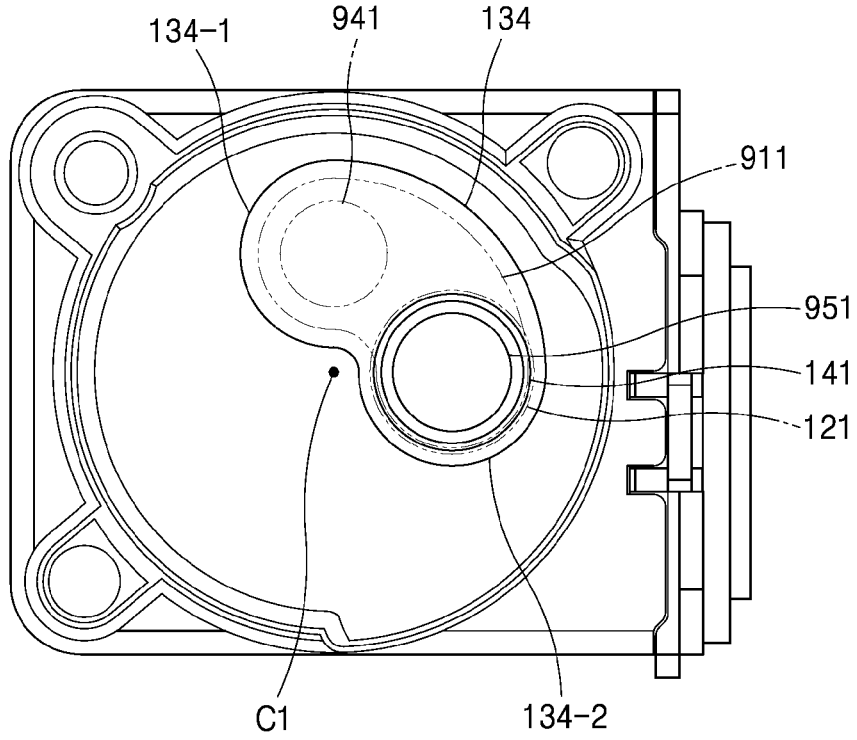

[Fig. 13]
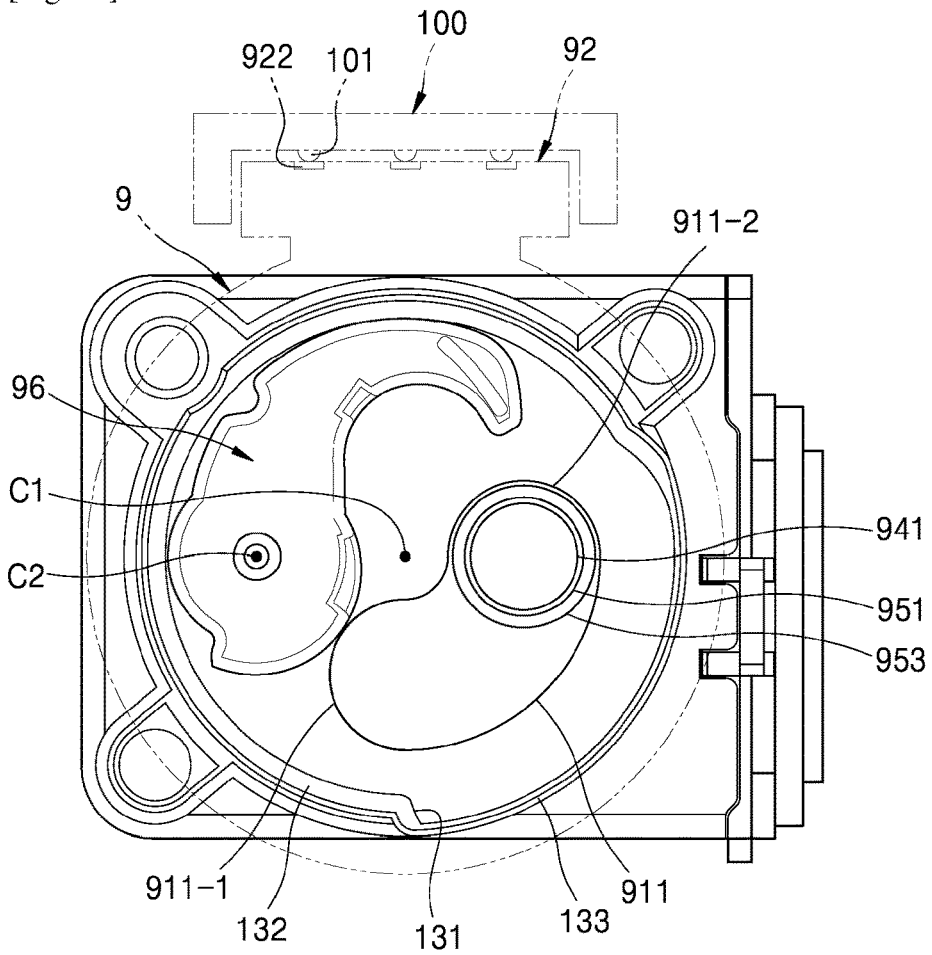
[Fig. 14]
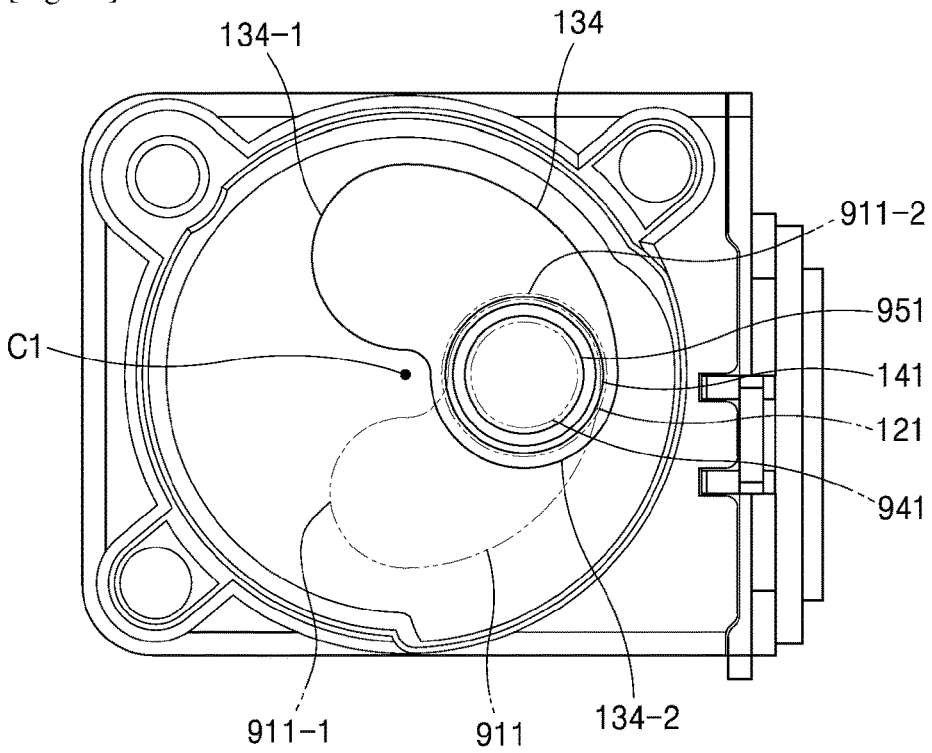

TONER REFILL CARTRIDGE WITH HOLDER HOLDING MEMORY UNIT THEREON AND ROTATABLE WITH RESPECT TO CARTRIDGE BODY

BACKGROUND ART

Printers using an electrophotographic method form a visible toner image on a photoconductor by supplying toner to an electrostatic latent image formed on the photoconductor, transfer the toner image to a print medium via an intermediate transfer medium or directly transfer the toner image to the print medium, and then fix the transferred toner image on the print medium.

A development cartridge accommodates toner, and the toner from the development cartridge is supplied to an electrostatic latent image formed on a photoconductor, thereby forming a visible toner image. When the toner from the development cartridge is consumed, the development cartridge is detached from a main body of a printer, and a new development cartridge may be installed in the main body. The development cartridge may be refilled with new toner by using a toner cartridge (toner refilling cartridge).

BRIEF DESCRIPTION OF DRAWINGS

FIG. 1 is a schematic appearance perspective view illustrating an example of an electrophotographic printer;

FIG. 2 is a schematic configurational view of the example of the electrophotographic printer illustrated in FIG. 1;

FIG. 3 is a schematic perspective view illustrating a state in which a toner cartridge is installed at a toner refilling portion;

FIG. 4 is a perspective view of an example of a toner cartridge;

FIG. 5 is an exploded perspective view of an example of a toner cartridge;

FIG. 6 illustrates a state in which a holder is located at a home position;

FIG. 7 illustrates a state in which a holder is located at a rotated position;

FIG. 8 is an exploded perspective view of an example of a toner refilling portion;

FIG. 9 illustrates a positional relationship among a first toner discharge portion, a second toner discharge portion, a locking member, and a holder in a state in which a toner cartridge is located at an installation position;

FIG. 10 illustrates a positional relationship among a second toner discharge portion, a second toner inlet portion, and a first toner inlet portion in a state in which a toner cartridge is located at an installation position;

FIG. 11 illustrates a positional relationship among a first toner discharge portion, a second toner discharge portion, a locking member, and a holder in a state in which a toner cartridge is located at a first angular position;

FIG. 12 illustrates a positional relationship among a second toner discharge portion, a second toner inlet portion, and a first toner inlet portion in a state in which a toner cartridge is located at a first angular position;

FIG. 13 illustrates a positional relationship among a first toner discharge portion, a second toner discharge portion, a locking member, and a holder in a state in which a toner cartridge is located at a second angular position; and FIG. 14 illustrates a positional relationship among a second toner discharge portion, a second toner inlet portion, and a first toner inlet portion in a state in which a toner cartridge is located at a second angular position.

MODE FOR THE INVENTION

FIG. 1 is a schematic appearance perspective view illustrating an example of an electrophotographic printer. FIG. 2 is a schematic configurational view of the example of the electrophotographic printer illustrated in FIG. 1. Referring to FIGS. 1 and 2, the electrophotographic printer may include a main body 1 and a development cartridge 2 detachably installed in the main body 1. A door 3 may be installed in the main body 1. The door 3 partially opens or closes the main body 1. Although FIG. 1 illustrates that the door 3 is configured to open an upper portion of the main body 1, the door 3 may also be configured, if needed, to open a side portion or a front portion of the main body 1. After the door 3 is open, the development cartridge 2 may be installed/detached at/from the main body 1.

A photosensitive drum 21 is an example of a photoconductor on which an electrostatic latent image is formed, and may include a cylindrical metal pipe and a photosensitive layer that is formed on an outer circumferential surface of the cylindrical metal pipe and has photoconductivity. A charging roller 23 is an example of a charger for charging a surface of the photosensitive drum 21 with uniform electric potential. A charging bias voltage is applied to the charging roller 23. A corona charger (not shown) may also be used instead of the charging roller 23. A developing roller 22 supplies toner to an electrostatic latent image formed on the surface of the photosensitive drum 21 and develops the image.

In the case of a two-component developing method wherein toner and carrier are used as a developer, the developing roller 22 may be in a form in which a magnet is fixedly installed in a rotating sleeve. The sleeve may be placed apart at a distance of several tens to several hundreds of micrometers from the photosensitive drum 21. The carrier is attached to an outer circumference of the developing roller 22 by a magnetic force of the magnet, and the toner is attached to the carrier by electrostatic force, thereby forming a magnetic brush formed of the carrier and the toner on the outer circumference of the developing roller 22. The toner is transferred onto the electrostatic latent image formed on the photosensitive drum 21 by a developing bias voltage applied to the developing roller 22.

In the case of a one-component developing method wherein toner is used as a developer, the developing roller 22 may come into contact with the photosensitive drum 21, and may also be placed apart at a distance of several tens to several hundreds of micrometers from the photosensitive drum 21. In the present example, a one-component contact developing method, in which the developing roller 22 and the photosensitive drum 21 come into contact with each other, thus forming a development nip, is used. The developing roller 22 may be in a form in which an elastic layer (not shown) is formed on an outer circumference of a conductive metal core (not shown). When a developing bias voltage is applied to the developing roller 22, toner is transferred and attached to the electrostatic latent image formed on the surface of the photosensitive drum 21 via the development nip.

A supply roller 24 attaches toner to the developing roller 22. To attach toner to the developing roller 22, a supply bias voltage may be applied to the supply roller 24. Reference numeral 25 denotes a regulator configured to regulate the amount of toner attached to a surface of the developing roller 22. The regulator 25 may be, for example, a regulating blade, a tip end of which comes into contact with the developing roller 22 by a predetermined pressure. Reference numeral 26 denotes a cleaning member configured to remove residual toner and foreign matter from the surface of the photosensitive drum 21 during charging. The cleaning member 26 may be, for example, a cleaning blade, a tip end of which comes into contact with the surface of the photosensitive drum 21. Hereinafter, the foreign matter removed from the surface of the photosensitive drum 21 is referred to as waste toner.

An optical scanner 4 scans light modulated in accordance with image information onto the surface of the photosensitive drum 21 charged with uniform electric potential. The optical scanner 4 may be, for example, a laser scanning unit (LSU) configured to deflect light emitted from a laser diode in a main scanning direction by using a polygon mirror and scan the deflected light onto the photosensitive drum 21.

A transfer roller 5 is an example of a transfer unit placed opposite the photosensitive drum 21 and configured to form a transfer nip. A transfer bias voltage is applied to the transfer roller 5 so as to transfer a toner image developed on the surface of the photosensitive drum 21 to a print medium P. Instead of the transfer roller 5, a corona transfer unit may also be used.

The toner image, which is transferred to a surface of the print medium P by the transfer roller 5, is maintained on the surface of the print medium P by electrostatic attraction. A fuser 6 fixes the toner image onto the print medium P by applying heat and pressure thereto, thus forming a permanent printed image on the print medium P.

FIG. 3 is a schematic perspective view illustrating a state in which a toner cartridge 9 is installed at a toner refilling portion 10. Referring to FIGS. 2 and 3, the development cartridge 2 of the present example includes a developing portion 210 in which the photosensitive drum 21 and the developing roller 22 are installed, a waste toner container 220 configured to accommodate waste toner removed from the photosensitive drum 21, and a toner container 230 connected to the developing portion 210 and configured to accommodate toner. To refill the toner container 230 with toner, the development cartridge 2 includes the toner refilling portion 10 connected to the toner container 230. The toner refilling portion 10 provides an interface between the toner cartridge 9, which will be described below, and the development cartridge 2. The development cartridge 2 is an integrated-type development cartridge including the developing portion 210, the waste toner container 220, the toner container 230, and the toner refilling portion 10.

A portion of an outer circumference of the photosensitive drum 21 is exposed to the outside of a housing. The exposed portion of the photosensitive drum 21 comes into contact with the transfer roller 5, thereby forming a transfer nip. The developing portion 210 may include at least one conveying member configured to convey toner towards the developing roller 22. The conveying member may also serve to charge toner with a predetermined electric potential by stirring the toner.

The waste toner container 220 is located on an upper side of the developing portion 210. The waste toner container 220 is spaced apart from the developing portion 210 in an upward direction, and a light path 250 is formed therebetween. The waste toner, which is removed from the photosensitive drum 21 by the cleaning member 26, is accommodated in the waste toner container 220. The waste toner removed from the surface of the photosensitive drum 21 is transported into the waste toner container 220 by waste toner transporting members 221, 222, and 223. The type and number of waste toner transporting members are not particularly limited. According to the volume or type of the waste toner container 220, an appropriate number of waste toner transporting members may be installed at an appropriate position allowing waste toner to be effectively dispersed in the waste toner container 220.

The toner container 230 is connected to the toner refilling portion 10 to accommodate toner. As illustrated by dotted lines in FIG. 2, the toner container 230 is connected to the developing portion 210 via a toner supply unit 234. As illustrated in FIG. 2, the toner supply unit 234 may be connected to the developing portion 210 by passing through the waste toner container 220 vertically. The toner supply unit 234 is placed outside an effective width of an exposed light L so as not to interfere with the exposed light L injected in a main scanning direction by the optical scanner 4.

The toner container 230 may be provided with toner supply members 231, 232, and 233 configured to supply toner to the developing portion 210 via the toner supply unit 234. The type and number of toner supply members are not particularly limited. According to the volume or type of the toner container 230, an appropriate number of toner supply members may be installed at an appropriate position in the toner container 230 so as to effectively supply toner to the developing portion 210. The toner supply member 233 may convey toner in a main scanning direction and transfer the toner to the toner supply unit 234.

An image forming process will now be briefly described using the above-described configurations. A charging bias is applied to the charging roller 23, and the photosensitive drum 21 is charged with uniform electric potential. The optical scanner 4 injects light modulated in response to image information into the photosensitive drum 21 to thereby form an electrostatic latent image on the surface of the photosensitive drum 21. The supply roller 24 attaches toner to the surface of the developing roller 22. The regulator 25 forms a toner layer having a uniform thickness on the surface of the developing roller 22. A developing bias voltage is applied to the developing roller 22. As the developing roller 22 rotates, toner transported to a developing nip is transferred and attached onto the electrostatic latent image formed on the surface of the photosensitive drum 21 by the developing bias voltage, thereby forming a visible toner image on the surface of the photosensitive drum 12. The print medium P taken out of a loading tray 7 by a pickup roller 71 is transferred to a transfer nip configured such that the transfer roller 5 and the photosensitive drum 21 face each other, by a transporting roller 72. When a transfer bias voltage is applied to the transfer roller 5, the toner image is transferred onto the print medium P by electrostatic attraction. The toner image transferred onto the print medium P is fixed on the print medium P by receiving heat and pressure from the fuser 6, thus completing printing. The print medium P is discharged by a discharge roller 73. Toner that is not transferred onto the print medium P and remains on the surface of the photosensitive drum 21 is removed by the cleaning member 26.

As described above, the development cartridge 2 of the present example includes the toner refilling portion 10 for refilling toner. According to the printer of the present example, the development cartridge 2 may be refilled with toner in a state in which the development cartridge 2 is installed in the main body 1 without being detached from the main body 1.

FIG. 3 is a schematic perspective view illustrating a state in which the toner cartridge 9 is installed at the toner refilling portion. Referring to FIGS. 1 and 3, the main body 1 includes a communicating portion 8 to allow an access to the toner refilling portion 10 from the outside of the main body 1 in a state in which the development cartridge 2 is installed in the main body 1. For example, when the toner cartridge (toner refilling cartridge) 9, in which toner is accommodated, is inserted into the communicating portion 8, the toner cartridge 9 may be connected to the toner refilling portion 10. In this state, the toner container 230 may be refilled with the toner from the toner cartridge 9 via the toner refilling portion 10. The toner cartridge 9 is detached from the communicating portion 8 after toner refilling is completed.

By using the above-described configurations, the toner container 230 may be refilled with toner via the toner refilling portion 10, and thus the replacement time of the development cartridge 2 may be extended until the lifetime of the photosensitive drum 21 ends, thus reducing the printing costs per sheet of paper. Since toner refilling is possible in a state in which the development cartridge 2 is installed in the main body 1, user convenience may be enhanced.

The communicating portion 8 may be provided at a position close to a front portion 1-2 of the main body 1. The front portion 1-2 is opposite to a user, and thus the user may easily access the communicating portion 8. Thus, a toner refilling operation may be easily performed via the communicating portion 8.

The communicating portion 8 may be provided at an upper surface 1-1 of the main body 1. The toner refilling portion 10 is located below the communicating portion 8. The communicating portion 8 and the toner refilling portion 10 may be aligned with respect to each other vertically. The toner cartridge 9 may provide access to the toner refilling portion 10 via the communicating portion 8 from an upper side of the main body 1. For example, when the toner cartridge 9 is inserted into the communicating portion 8 from the upper side of the main body 1, the toner cartridge 9 may be connected to the toner refilling portion 10.

FIG. 4 is a perspective view of an example of the toner cartridge 9. Referring to FIG. 4, the toner cartridge 9 may be a syringe-type toner refilling cartridge including: a body 91 configured to accommodate toner and including a toner discharge portion 94 configured to discharge toner; and a plunger 93 provided in the body 91 and configured to push the toner to the outside of the body 91 via the toner discharge portion 94. The plunger 93 may be, for example, movably coupled to the body 91 in a longitudinal direction A. As illustrated in FIG. 3, when the plunger 93 is pressed in the longitudinal direction A in a state in which the toner cartridge 9 is installed at the toner refilling portion 10, the toner may be supplied to the toner container 230 of the development cartridge 2 from the body 91 via the toner refilling portion 10. The longitudinal direction A may be parallel to a first rotation axis C1. The body 91 may have, for example, a cylindrical shape. The first rotation axis C1 may be a central axis of the body 91 having a cylindrical shape. The toner cartridge 9 may include a memory unit 921 including an electrical contact portion 922 for electrical connection with the main body 1. The memory unit 921 is loaded in a holder 92. The holder 92 is connected to the body 91 such that the holder 92 is rotatable relative to the body 91.

When the toner cartridge 9 is installed at the toner refilling portion 10, the memory unit 921 may be electrically connected to the main body 1. The main body 1 may determine whether or not the toner cartridge 9 is installed, according to whether or not to be electrically connected with the memory unit 921, for example, whether or not to be capable of communicating with the memory unit 921. The memory unit 921 may include a circuit unit configured to monitor or manage a state of the toner cartridge 9, and the electrical contact portion 922 for connection with the main body 1. The circuit unit may be provided with, for example, a customer replaceable unit monitor (CRUM) unit including a central process unit (CPU) that executes at least one of authentication and encrypted data communication with the main body 1 using a self-operating system (O/S). The circuit unit may further include a memory. Various types of information for the toner cartridge 9 may be stored in the memory. For example, the memory may store information on a manufacturer, information on manufacturing data and time, unique information such as a serial number, a model name, and the like, various programs, electronic signature information, information on usage states (e.g., how many sheets of paper are printed up to now, how many sheets of printable paper are left, how much toner is left, and the like), and the like. In addition, the memory may also store information on lifetime of the toner cartridge 9, setup menu, and the like. In addition, the circuit unit may include a function block capable of performing various functions for communication with the main body 1, authentication, encryption, and the like. The circuit unit may be realized in the form of a chip including a CPU, a chip including a memory and a CPU, or a printed circuit board on which a chip and circuit elements for implementing various function blocks are mounted.

The electrical contact portion 922 may take various forms allowing electrical connection with the main body 1, such as a conductive pattern form, a modular jack form, an elastic terminal form, and the like. The electrical contact portion 922 of the present example is a conductive pattern. The electrical contact portion 922 is exposed to the outside of the holder 92. The electrical contact portion 922 may have electrical contact points. The electrical contact portion 922 may include at least one of a data electrical contact point for transmitting information of the circuit unit to the main body 1, an electrical contact point for transmitting a toner refilling completion signal to the main body 1, and an electrical contact point for transmitting, to the main body 1, a signal regarding whether or not the toner cartridge 9 is installed at the toner refilling portion 10.

Referring to FIG. 3, when the toner cartridge 9 is installed at the toner refilling portion 10, the holder 92 is accommodated in a connecting portion 100 provided in the main body 1. The connecting portion 100 is provided with an electrical terminal portion 101 (see FIG. 9) electrically connected to the electrical contact portion 922.

The toner cartridge 9 may be installed at the toner refilling portion 10 and rotated about the first rotation axis C1 to an installation position B0 to a first angular position B1 to a second angular position B2. This will be described below, and herein, definition of the installation position B0, the first angular position B1, and the second angular position B2 will be briefly described. The installation position B0 refers to a position of the toner cartridge 9 in a state of being inserted into the main body 1 via the communicating portion 8 and installed at the toner refilling portion 10. The first angular position B1 refers to a position at which the toner cartridge 9 is rotated by a first angle from the installation position B0. The second angular position B2 refers to a position at which the toner cartridge 9 is rotated by a second angle from the first angular position B1. Rotation of the toner cartridge 9 from the installation position B0 to the first angular position B1 is referred to as a first rotation, and rotation of the toner cartridge 9 from the first angular position B1 to the second angular position B2 is referred to as a second rotation.

As described above, the toner cartridge 9 is installed at the toner refilling portion 10 and rotated to the installation position B0 to the first angular position B1 to the second angular position B2. For stable electrical connection between the memory unit 921 and the main body 1, the holder 92 is connected to the body 91 to be rotatable relative to the body 91. When the toner cartridge 9 is installed in the main body 1, the holder 92 is accommodated in the connecting portion 100. The connecting portion 100 holds the holder 92 when the toner cartridge 9 is rotated. Thus, the holder 92 is maintained in a state of being accommodated in the connecting portion 100, and the body 91 is rotated to the first angular position B1 and the second angular position B2. Accordingly, stable electrical connection between the main body 1 and the memory unit 921 may be maintained.

Hereinafter, an example of the toner cartridge 9 and an example of an interface structure (toner refilling interface structure) between the toner cartridge 9 and the toner refilling portion 10 will be described.

FIG. 5 is an exploded perspective view of an example of the toner cartridge 9. FIG. 6 illustrates a state in which the holder 92 is located at a home position. FIG. 7 illustrates a state in which the holder 92 is located at a rotated position. FIG. 8 is an exploded perspective view of an example of the toner refilling portion 10. FIG. 9 illustrates a positional relationship among the first toner discharge portion 941, the second toner discharge portion 951, the locking member 96, and the holder 92 in a state in which the toner cartridge 9 is located at the installation position B0. FIG. 10 illustrates a positional relationship among the second toner discharge portion 951, the second toner inlet portion 141, and the first toner inlet portion 121 in a state in which the toner cartridge 9 is located at the installation position B0. FIG. 11 illustrates a positional relationship among the first toner discharge portion 941, the second toner discharge portion 951, the locking member 96, and the holder 92 in a state in which the toner cartridge 9 is located at the first angular position B1. FIG. 12 illustrates a positional relationship among the second toner discharge portion 951, the second toner inlet portion 141, and the first toner inlet portion 121 in a state in which the toner cartridge 9 is located at the first angular position B1. FIG. 13 illustrates a positional relationship among the first toner discharge portion 941, the second toner discharge portion 951, the locking member 96, and the holder 92 in a state in which the toner cartridge 9 is located at the second angular position B2. FIG. 14 illustrates a positional relationship among the second toner discharge portion 951, the second toner inlet portion 141, and the first toner inlet portion 121 in a state in which the toner cartridge 9 is located at the second angular position B2.

First, the example of the toner cartridge 9 will be described in detail with reference to FIGS. 4, 5, 6, and 7.

Referring to FIGS. 4 and 5, as described above, the holder 92 is coupled to the body 91 to be rotatable relative to the body 91. The holder 92 may be rotated relative to the body 91 to a home position (see FIG. 6) and a rotated position (see FIG. 7). The toner cartridge 9 is installed at the toner refilling portion 10 in a state in which the holder 92 is located at the home position, and the holder 92 is accommodated in the connecting portion 100 provided in the main body 1. The rotated position may correspond to the second angular position B2 of the toner cartridge 9. Thus, an angular spacing between the home position and the rotated position may be the same as that between the installation position B0 and the second angular position B2. The angular spacing between the home position and the rotated position may be, for example, 180°.

The holder 92 may be rotated relative to the body 91 about the first rotation axis C1.

The holder 92 may include a cylindrical portion 923 rotatably coupled to the body 91, an accommodating portion 924 configured to accommodate the memory unit 921, and a cover 925 configured to cover the accommodating portion 924. The accommodating portion 924 may be in a form extending form an outer circumferential portion of the cylindrical portion 923 in the longitudinal direction A. The electrical contact portion 922 of the memory unit 921 may be exposed to the outside via an opening 925-1 provided in the cover 925.

In one example, the body 91 may include a first body 91-1 having toner accommodated therein, and a second body 91-2 coupled to a tip end portion of the first body 91-1. For example, the first body 91-1 may be snap-fit coupled to the second body 91-2. For this, a hook 913-1 may be provided at the first body 91-1 and a locking groove 913-2 caught by the hook 913-1 may be provided at the second body 91-2. The holder 92 may be rotatably supported by the second body 91-2. A cylindrical outer circumferential portion 916 is provided in the second body 91-2. The cylindrical portion 923 of the holder 92 may be rotatably inserted into the cylindrical outer circumferential portion 916.

The toner cartridge 9 may include an elastic member 929 configured to apply an elastic force to the holder 92 to be rotated in a direction returning to the home position from the rotated position. The elastic member 929 may be implemented in various forms. In the present example, the elastic member 929 is realized by a torsion coil spring, one end portion 929-1 of which is supported by the second body 91-2 and another end portion 929-2 of which is supported by the holder 92. The holder 92 may be maintained at the home position by the elastic member 920 in a state in which the toner cartridge 9 is not installed at the toner refilling portion 10. Thus, when the toner cartridge 9 is installed at the toner refilling portion 10, the holder 92 may be spontaneously accommodated in the connecting portion 100 provided in the main body 1.

The toner cartridge 9 may include a rotation preventing unit configured to prevent the holder 92 from being rotated beyond the home position. The rotation preventing unit prevents the holder 92 from being rotated beyond the home position when the holder 92 returns to the home position by the elastic force of the elastic member 929. The rotation preventing unit may prevent the holder 92 from being rotated beyond the rotated position. In one example, the rotation preventing unit may be realized by a combination of a regulating slot and a stopper caught by the regulating slot. The rotation preventing unit may include: a regulating slot 926 provided in any one of the body 91 and the holder 92 and including a first end portion 926-1 and a second end portion 926-2 that respectively correspond to the home position and the rotated position; and a stopper 917 provided in the other one of the body 91 and the holder 92 and caught by the first end portion 926-1 and the second end portion 926-2 at the home position and the rotated position, respectively. For example, the regulating slot 926 may be provided in the holder 92, and the stopper 917 may be provided in the body 91, and an opposite case is also possible.

Referring to FIGS. 5, 6, and 7, the regulating slot 926 may be provided in a cut form in the cylindrical portion 923. An angular spacing between the first end portion 926-1 and the second end portion 926-2 may be the same as that between the home position and the rotated position. The stopper 917 may be provided at the cylindrical outer circumferential portion 916 of the second body 91-2. The stopper 917 radially protrudes outside of the cylindrical outer circumferential portion 916 and is inserted into the regulating slot 926. Due to insertion of the stopper 917 into the regulating slot 926, movement of the holder 92 along the first rotation axis C1 with respect to the body 91, i.e., the second body 91-2 may be restricted, and the holder 92 may be rotatably supported by the second body 91-2. Thus, the regulating slot 926 and the stopper 917 may function as escape preventing units such that the holder 92 does not escape from the body 91, i.e., the second body 91-2.

As illustrated in FIG. 6, when the holder 92 is located at the home position, the stopper 917 is caught by the first end portion 926-1 of the regulating slot 926, and the holder 92 is unable to be rotated with respect to the body 91 beyond the home position. The holder 92 is maintained at the home position by the elastic force of the elastic member 929. Thus, the holder 92 is located at the home position at all times in a state of being separated from the toner refilling portion 10, and in this state, the toner cartridge 9 may be directly installed at the toner refilling portion 10.

As illustrated in FIG. 7, when the holder 92 is located at the rotated position, the stopper 917 is caught by the second end portion 926-2 of the regulating slot 926, and the holder 92 is unable to be rotated with respect to the body 91 beyond the rotated position.

Referring back to FIGS. 4 and 5, the toner cartridge 9 may include a discharge shutter 95 installed in the body 91 such that the discharge shutter 95 is rotatable to a discharge position at which the toner discharge portion 94 is open and a closed position at which the toner discharge portion 94 is closed.

In one example, the toner discharge portion 94 extends outward from the body 91, and thus, when the toner cartridge 9 is installed at the toner refilling portion 10, the toner discharge portion 94 may be inserted into the second toner inlet portion 141 (see FIG. 8) of an inlet shutter 14 (see FIG. 8), which will be described below. The toner discharge portion 94 may include the first toner discharge portion 941 provided in the body 91 and the second toner discharge portion 951 provided in the discharge shutter 95. The discharge shutter 95 allows the first toner discharge portion 941 to be closed at the closed position (see FIG. 9) and to be open at the discharge position (see FIG. 13). For example, the first toner discharge portion 941 is aligned with the second toner discharge portion 951 at the discharge position, and the first toner discharge portion 941 is not aligned with the second toner discharge portion 951 at the closed position so that the first toner discharge portion 941 is closed by the discharge shutter 95. The holder 92 and the discharge shutter 95 may be rotated relative to the body 91 about the same rotation axis. The discharge shutter 95 may be rotated relative to the body 91 about the first rotation axis C1 to the closed position and the discharge position. The first toner discharge portion 941 and the second toner discharge portion 951 may be eccentrically located by the same distance radially from the first rotation axis C1.

The first toner discharge portion 941 may be provided at the first body 91-1. The discharge shutter 95 may be located between the first body 91-1 and the second body 91-2. The first toner discharge portion 941 may be in a form extending towards the discharge shutter 95 from the first body 91-1. The discharge shutter 95 may be, for example, rotatably supported by the second body 91-2. For example, an outer support portion 912 having a cylindrical shape, based on the first rotation axis C1 may be provided in the second body 91-2, and an inner support portion 952 may be provided in the discharge shutter 95 such that the inner support portion 952 is rotatably supported by an inner side of the outer support portion 912.

In one example, the toner discharge portion 94 protrudes outside of the body 91, and thus, when the toner cartridge 9 is installed at the toner refilling portion 10, the toner discharge portion 94 may be inserted into the second toner inlet portion 141 (see FIG. 8) of the inlet shutter 14 (see FIG. 8), which will be described below. The second toner discharge portion 951 may extend outward from the body 91 and thus protrude outside of the body 91. The second body 91-2 is provided with a second slot 911 passing therethrough such that the second toner discharge portion 951 protrudes outside of the second body 91-2. The second slot 911 may function as a second rotation restricting portion that restricts a relative rotation angle of the body 91 with respect to the discharge shutter 95. The second slot 911 may have a circular arc shape based on the first rotation axis C1 so as to restrict the relative rotation angle of the body 91 with respect to the discharge shutter 95. One end portion and another end portion of the second slot 911 may respectively correspond to the closed position and discharge position of the discharge shutter 95. When the discharge shutter 95 reaches the closed position, the second toner discharge portion 951 is caught by the one end portion of the second slot 911. When the discharge shutter 95 reaches the discharge position, the second toner discharge portion 951 is caught by the other end portion of the second slot 911. Thus, the body 91 is no longer rotated relative to the discharge shutter 95.

A first sealing member 98 may be disposed between the first body 91-1 and the discharge shutter 95. The first sealing member 98 may be rotated relative to the body 91 along with the discharge shutter 95. A through-hole 981 aligned with the second toner discharge portion 951 is provided in the first sealing member 98. The first sealing member 98 closes the first toner discharge portion 941 between the closed position and discharge position of the discharge shutter 95. When the discharge shutter 95 is located at the discharge position, the first toner discharge portion 941, the through-hole 981, and the second toner discharge portion 951 may be aligned with respect to one another such that toner is discharged outside of the body 91. When the discharge shutter 95 escapes from the discharge position, the first toner discharge portion 941 is closed by the first sealing member 98. By adopting the first sealing member 98, the leakage of toner between the first body 91-1 and the discharge shutter 95 may be prevented.

The toner cartridge 9 may include the locking member 96 configured to selectively lock the discharge shutter 95 at the closed position. The locking member 96 locks the discharge shutter 95 at the closed position during a first rotation of the toner cartridge 9, i.e., during rotation of the toner cartridge 9 from the installation position B0 to the first angular position B1. For example, a first interference portion 953 may be provided in the discharge shutter 95. The locking member 96 may include a second interference portion 963 corresponding to the first interference portion 953. The locking member 96 may be supported by the body 91 such that the locking member 96 is rotatable about a second rotation axis C2, which is different from the first rotation axis C1, to a locked position (see FIG. 9) at which the first interference portion 953 of the discharge shutter 95 located at the closed position is caught by the second interference portion 963, thereby not allowing the discharge shutter 95 to rotate and to an unlocked position (see FIG. 11) at which the discharge shutter 95 is allowed to rotate. A locking spring 97 applies an elastic force to the locking member 96 in a direction returning to the locked position from the unlocked position. The locking spring 97 may apply, to the locking member 96, an elastic force in a direction locking the discharge shutter 95 at the closed position. In a state in which the locking member 96 is located at the locked position, the first interference portion 953 is caught by the second interference portion 963, and thus the discharge shutter 95 is unable to be rotated to the discharge position and is maintained at the closed position. The locking member 96 locks the discharge shutter 95 in a state of being located at the closed position before the toner cartridge 9 is installed at the toner refilling portion 10. Accordingly, unintended toner leakage may be prevented. When the locking member 96 is located at the unlocked position, the second interference portion 963 is separated from the first interference portion 953, and the discharge shutter 95 may be rotated to the discharge position from the closed position.

In one example, the locking member 96 may include a support shaft 964 extending along the second rotation axis C2 and having an end portion rotatably supported by the second body 91-2. A support hole 914 through which the end portion of the support shaft 964 is inserted and by which the end portion thereof is rotatably support may be provided in the second body 91-2. A support portion 954 by which another end portion of the support shaft 964 is rotatably supported is provided in the discharge shutter 95. Since the discharge shutter 95 is rotated about the first rotation axis C1 to the closed position and the discharge position, this corresponds to a case in which the locking member 96 is rotated relative to the discharge shutter 95 about the first rotation axis C1. Thus, the support portion 954 may have a circular arc shape allowing relative rotation of the locking member 96 with respect to the first rotation axis C1. The support portion 954 supports the other end portion of the support shaft 964 such that the end portion of the support shaft 964 does not escape from the support hole 914. Due to such a configuration, a separate support member not allowing the end portion of the support shaft 964 to escape from the support hole 914 may not be adopted, and thus the toner cartridge 9 may have a simplified structure and the number of assembly processes is decreased, thus reducing cost of the toner cartridge 9.

The locking member 96 may include an external force receiver 965 exposed to the outside of the body 91 so as to receive an external force for switching to the unlocked position from the locked position. For example, a through groove 915 may be provided at a side portion of the second body 91-2, and the external force receiver 965 may be exposed to the outside of the second body 91-2 via the through groove 915. The external force receiver 965 may be interfered with a releasing portion 131 (see FIG. 11) provided in the toner refilling portion 10, for example, when the toner cartridge 9 is installed at the toner refilling portion 10. The toner cartridge 9 is installed at the toner refilling portion 10 and is rotated about the first rotation axis C1. When the toner cartridge 9 reaches the first angular position B1, the external force receiver 965 may be interfered with the releasing portion 131, and thus the locking member 96 may switch to the unlocked position from the locked position and the discharge shutter 95 may be unlocked.

The locking spring 97 may have various shapes, for example, a coil spring, a leaf spring, an elastic arm formed integrally with the locking member 96, and the like. In the present example, the locking member 96 is realized by a torsion coil spring having a central coil winding portion installed on the support shaft 964, an end portion supported by the locking member 96, and another end portion supported by the second body 91-2.

Hereinafter, an example of an interface structure between the toner cartridge 9 and the toner refilling portion 10 will be described.

A toner refilling interface structure may include the toner cartridge 9, the toner refilling portion 10, and the connecting portion 100. As illustrated in FIG. 3, the connecting portion 100 is provided in the main body 1. The toner refilling portion 10 is formed integrally with the development cartridge 2, and may be attachable/detachable to/from the main body 1 along with the development cartridge 2. When the development cartridge 2 is installed in the main body 1, the toner refilling portion 10 is located adjacent to the connecting portion 100.

Referring to FIG. 8, the toner refilling portion 10 may include an installation portion 11 at which the toner cartridge 9 is installed, the first toner inlet portion 121, and the inlet shutter 14.

The installation portion 11 has a structure capable of being rotated about the first rotation axis C1 in a state in which the toner cartridge 9 is installed at the installation portion 11. The first toner inlet portion 121 is provided in the installation portion 11 so as to receive toner from the toner cartridge 9. For example, the installation portion 11 may include a lower body 12 and an upper body 13. The upper body 13 is coupled to the lower body 12. The upper body 13 has a structure by which the toner cartridge 9 may be rotatably supported. For example, a first accommodating portion 132 configured to accommodate a tip end portion of the toner cartridge 9 and having a cylindrical shape is provided in the upper body 13. The first accommodating portion 132 may be realized by, for example, a cylindrical rib based on the first rotation axis C1 and protruding upward. The lower body 12 is connected to the toner container 230. The first toner inlet portion 121 is provided in the lower body 12. The releasing portion 131 may be provided in the installation portion 11. The releasing portion 131 is interfered with the locking member 96 when the toner cartridge 9 is located at the first angular position B1, and thus unlocks the discharge shutter 95 so that the body 91 is rotated relative to the discharge shutter 95 to the second angular position B2 at which the first and second toner discharge portions 941 and 951 are aligned with each other, from the first angular position B1. For example, the first accommodating portion 132 partially expands outward in a radius direction, and accordingly, a second accommodating portion 133 having a greater diameter than that of the first accommodating portion 132 is formed. The diameter of the second accommodating portion 133 with respect to the first rotation axis C1 is determined such that the external force receiver 965 of the locking member 96 is not interfered. The releasing portion 131 may be realized by a boundary between the first accommodating portion 132 and the second accommodating portion 133.

The inlet shutter 14 is provided in the installation portion 11 such that the inlet shutter 14 may switch to a blocked position (see FIG. 10) at which the first toner inlet portion 121 is blocked and an inflow position (see FIG. 12) at which the first toner inlet portion 121 is open. The inlet shutter 14 may be rotated with respect to the first rotation axis C1 to the blocked position and the inflow position. In one example, the inlet shutter 14 may include the second toner inlet portion 141. At the blocked position, the first toner inlet portion 121 is not aligned with the second toner inlet portion 141, and thus the first toner inlet portion 121 is blocked. At the inflow position, the first toner inlet portion 121 is aligned with the second toner inlet portion 141, and thus the first toner inlet portion 121 is open.

The inlet shutter 14 may be disposed between the lower body 12 and the upper body 13. The inlet shutter 14 may be rotatably supported by the lower body 12. The lower body 12 is provided with a first cylindrical portion 122 configured to rotatably support the inlet shutter 14 about the first rotation axis C1. The first cylindrical portion 122 may be realized by, for example, a cylindrical rib based on the first rotation axis C1 and protruding towards the upper body 13. The inlet shutter 14 is supported by the lower body 12 such that a second cylindrical portion 142 forming an outer circumference of the inlet shutter 14 is located inside the first cylindrical portion 122. The upper body 13 is coupled to the lower body 12 such that the upper body 13 covers the inlet shutter 14.

The inlet shutter 14 may switch to the inflow position from the blocked position by the first rotation of the toner cartridge 9. The toner discharge portion 94 may be coupled to the second toner inlet portion 141. For example, the second toner discharge portion 951 protruding outside of the body 91 may be inserted into the second toner inlet portion 141. When the toner cartridge 9 is installed at the installation portion 11 and is rotated with respect to the first rotation axis C1, the second toner discharge portion 951 may push the second toner inlet portion 141 to thereby rotate the inlet shutter 14 to the inflow position from the blocked position.

A first rotation restricting portion may be provided in the installation portion 11. The first rotation restricting portion is interfered with the second toner inlet portion 141 when the toner cartridge 9 is located at the first angular position B1 so that the inlet shutter 14 is not rotated beyond the first angular position B1, i.e., the inflow position. Due to the first rotation restricting portion, a state in which the toner discharge portion 94, the second toner inlet portion 141, and the first toner inlet portion 121 are aligned with respect to one another is maintained at the first angular position B1. In one example, the first rotation restricting portion may be realized by a first slot 134 provided in the upper body 13. The first slot 134 is formed in the upper body 13 by passing therethrough so that the second toner inlet portion 141 is insertable through the first slot 134. The second toner inlet portion 141 protrudes upward from the inlet shutter 14 and is inserted into the first slot 134. The first slot 134 may have a circular arc shape including opposite end portions at which the second toner inlet portion 141 is located at the installation position B0 and the first angular position B1, respectively.

A second sealing member 15 may be disposed between the lower body 12 and the inlet shutter 14. The second sealing member 15 may be fixedly installed in the lower body 12. A through-hole 151 aligned with the first toner inlet portion 121 is provided in the second sealing member 15. The second sealing member 15 blocks the second toner inlet portion 141 between the blocked position and the inflow position of the inlet shutter 14. When the inlet shutter 14 is located at the inflow position, the first toner inlet portion 121, the through-hole 151, and the second toner inlet portion 141 are aligned with respect to one another, and thus toner may be introduced into the first toner inlet portion 121 from the outside. When the inlet shutter 14 escapes from the inflow position, the second toner inlet portion 141 is blocked by the second sealing member 15. By adopting the second sealing member 15, toner leakage between the lower body 12 and the inlet shutter 14 may be prevented.

An example of a process of refilling the toner container 230 with toner by the above-described toner refilling interface structure will be briefly described.

The holder 92 is located at the home position until the toner cartridge 9 is installed at the toner refilling portion 10. As illustrated in FIG. 6, the stopper 917 is caught by the first end portion 926-1 of the regulating slot 926, and the holder 92 is maintained at the home position by the elastic force of the elastic member 929. The discharge shutter 95 is located at the closed position at which the first toner discharge portion 941 and the second toner discharge portion 951 are not aligned with respect to each other. The locking member 96 is located at the locked position, thus locking the discharge shutter 95 at the closed position. Accordingly, toner leakage may be prevented. A phase of the holder 92 with respect to the first rotation axis C1 at the home position is the same as that of the discharge shutter 95 at the closed position. In other words, the phase of the holder 92 with respect to the first rotation axis C1 at the home position is the same as that of the second toner discharge portion 951 protruding outside of the body 191 and located at the closed position. Accordingly, the home position of the holder 92 and the closed position of the discharge shutter 95 may be visually confirmed, and the presence or absence of abnormality of the toner cartridge 9 may be visually confirmed.

The toner cartridge 9 is inserted into the main body 1 via the communicating portion 8 of the main body 1. Then, as illustrated in FIGS. 9 and 10, the tip end portion of the toner cartridge 9 is accommodated in the first accommodating portion 132 of the toner refilling portion 10, and the toner cartridge 9 is located at the installation position B0.

The holder 92 is accommodated in the connecting portion 100. Thus, the electrical contact portion 922 of the memory unit 921 is electrically connected to a controller (not shown) of the main body 1 via the electrical terminal portion 101 provided on the connecting portion 100. Accordingly, communication between the memory unit 921 and the main body 1 is possible. When the controller is able to communicate with, for example, the memory unit 921, it may be recognized that the toner cartridge 9 is installed at the toner refilling portion 10.

The discharge shutter 95 is located at the closed position, and the first toner discharge portion 941 is in a state of not being aligned with the second toner discharge portion 951. The external force receiver 965 of the locking member 96 is placed in the second accommodating portion 133, and thus the locking member 96 is maintained at the locked position at which the discharge shutter 95 is locked at the closed position. The second toner discharge portion 951 passes through the second slot 911 (a second rotation restricting portion) and protrudes from the body 91, and passes through the first slot 134 (the first rotation restricting portion) and is inserted into the second toner inlet portion 141. The second toner discharge portion 951 is placed at a first end portion 911-1 of the second slot 911. The inlet shutter 14 is located at the blocked position, and the first toner inlet portion 121 is in a state of not being aligned with the second toner inlet portion 141. The second toner inlet portion 141 is placed at the first end portion 134-1 of the first slot 134. As such, the discharge shutter 95 is also maintained at the closed position in a state in which the inlet shutter 14 is located at the blocked position, and thus toner leakage may be prevented.

Then, the toner cartridge 9 is rotated to the first angular position B1 from the installation position B0. This is referred to as a first rotation. The first angular position B1 may be, for example, a position apart by 90° from the installation position B0.

The holder 92 is rotatable relative to the body 91. The holder 92 is accommodated in the connecting portion 100. Thus, when rotating the toner cartridge 9 about the first rotation axis C1, the holder 92 is maintained in a state of being accommodated in the connecting portion 100 and the body 91 is rotated. Accordingly, the electrical contact portion 922 of the memory unit 921 is maintained in a state of being electrically connected to the controller (not shown) of the main body 1 via the electrical terminal portion 101 provided on the connecting portion 100.

During the first rotation of the toner cartridge 9, the discharge shutter 95 is in a state of being locked at the closed position by the locking member 96. When rotating the toner cartridge 9 about the first rotation axis C1, the body 91 and the discharge shutter 95 are rotated along therewith. When rotating the toner cartridge 9 at 90°, as illustrated in FIG. 11, the second toner discharge portion 951 reaches the first angular position B1 in a state of being placed at the first end portion 911-1 of the second slot 911. The phases of the holder 92 and the discharge shutter 95, i.e., the second toner discharge portion 951, with respect to the first rotation axis C1 differ by an angle between the installation position B0 and the first angular position B1.

Since the discharge shutter 95 is still located at the closed position, the first toner discharge portion 941 is in a state of not being aligned with the second toner discharge portion 951. At this time, the external force receiver 965 of the locking member 96 is caught by the releasing portion 131 provided in the toner refilling portion 10. The locking member 96 escapes from the locked position and is somewhat rotated to the unlocked position. The second interference portion 963 is separated from the first interference portion 953.

Since the second toner discharge portion 951 is inserted into the second toner inlet portion 141, when the toner cartridge 9 is rotated, the inlet shutter 14 is also rotated along therewith. When rotating the toner cartridge 9 at 90°, as illustrated in FIG. 12, the inlet shutter 14 is located at the inflow position, and the second toner inlet portion 141 and the first toner inlet portion 121 are aligned with respect to each other. The second toner inlet portion 141 is caught by a second end portion 134-2 of the first slot 134, and thus the inlet shutter 14 is unable to be rotated beyond the inflow position, and is stopped at the inflow position, i.e., the first angular position B1. Since the second toner discharge portion 951 is inserted into the second toner inlet portion 141, the discharge shutter 95 is also unable to be rotated beyond the first angular position B1. Thus, the discharge shutter 95 may be locked at the first angular position B1 by the first slot 134. A state in which the second toner discharge portion 951, the second toner inlet portion 141, and the first toner inlet portion 121 are aligned with respect to each other is maintained at the first angular position B1 by the first slot 134. As such, the discharge shutter 95 is also maintained at the closed position by the locking member 96 until the inlet shutter 14 reaches the inflow position, and thus toner leakage may be prevented.

Next, the toner cartridge 9 is rotated to the second angular position B2 from the first angular position B1. This is referred to as a second rotation. The second angular position B2 may be, for example, a position apart by 90° from the first angular position B1. Since the holder 92 is rotatable relative to the body 91, the holder 92 is maintained in a state of being accommodated in the connecting portion 100 and the body 91 is rotated. When the toner cartridge 9, i.e., the body 91, reaches the second angular position B2, the holder 92 reaches the rotated position. As illustrated in FIG. 7, the stopper 917 is caught by the second end portion 926-2 of the regulating slot 926. Accordingly, the holder 92 is no longer rotatable relative to the body 91 beyond the rotated position.

Since the locking member 96 is located at the unlocked position, the discharge shutter 95 is in a state of being rotatable relative to the body 91. When continually rotating the toner cartridge 9, the discharge shutter 95 is maintained in a state of being stopped at the first angular position B1, and the body 91 and the locking member 96 are rotated relative to the discharge shutter 95. When the body 91 is rotated at 90° in a state in which the discharge shutter 95 is stopped, as illustrated in FIG. 13, the discharge shutter 95 switches to the discharge position, and thus the first toner discharge portion 941 is aligned with the second toner discharge portion 951. The rotation of the body 91 relative to the discharge shutter 95 is restricted by the second slot 911. When the toner cartridge 9 reaches the second angular position B2, the discharge shutter 95 switches to the discharge position and the second end portion 911-2 of the second slot 911 is caught by the second toner discharge portion 951. Accordingly, the rotation of the body 91 relative to the discharge shutter 95 is restricted by the second slot 911 such that the body 91 is not rotated beyond the second angular position B2. When the toner cartridge 9 reaches the second angular position B2, as illustrated in FIGS. 13 and 14, the first toner discharge portion 941, the second toner discharge portion 951, the second toner inlet portion 141, and the first toner inlet portion 121 are in a fluid communication with one another. As such, the discharge shutter 95 switches to the discharge position after the inlet shutter 14 reaches the inflow position.

When the plunger 93 is pressed, the toner container 230 may be refilled with toner by toner flowing from the body 91 via the first toner discharge portion 941, the second toner discharge portion 951, the second toner inlet portion 141, and the first toner inlet portion 121. When toner refilling is completed, the toner cartridge 9 is inversely rotated to separate the toner cartridge 9 from the toner refilling portion 10. A process of the toner cartridge 9 returning to the installation position B0 from the second angular position B2 via the first angular position B1 may be performed in an order opposite to that of the above-described installation process.

While the present disclosure has been described with reference to the examples illustrated in the drawings, these examples are provided for illustrative purposes, and it will be understood by those of ordinary skill in the art to which the disclosure pertains that various modifications and other examples equivalent thereto can be made. Therefore, the true scope of the present disclosure should be defined by the following claims.

The invention claimed is:

1. A toner cartridge including:

a body to accommodate toner and having a toner discharge portion;

a plunger provided in the body and to push the toner outside of the body via the toner discharge portion;

a memory unit including an electrical contact portion including at least one electrical contact point; and a holder to facilitate loading of the memory unit therein and being rotatable relative to the body between a home position and a rotated position.

2. The toner cartridge of claim 1, including an elastic member to apply an elastic force to the holder to be rotated in a direction to the home position from the rotated position.

3. The toner cartridge of claim 2, including a rotation preventing unit to contact the holder to prevent the holder from being rotated beyond the home position.

4. The toner cartridge of claim 3, wherein the rotation preventing unit is to contact the holder to prevent the holder from being rotated beyond the rotated position.

5. The toner cartridge of claim 4, wherein the rotation preventing unit includes:

a regulating slot provided in any one of the body and the holder, and including a first end portion and a second end portion, the first end portion corresponding to the home position and the second end portion corresponding to the rotated position; and a stopper provided in the other one of the body and the holder, and the stopper is to contact the first end portion at the home position and is to contact the second end portion at the rotated position.

6. The toner cartridge of claim 1, including a discharge shutter installed in the body, the discharge shutter being rotatable relative to the body to a discharge position and a closed position, wherein the toner discharge portion is open at the discharge position and is closed at the closed position, wherein the holder and the discharge shutter are rotatable about the same rotation axis.

7. The toner cartridge of claim 6, wherein the body has a cylindrical shape, and the rotation axis is a central axis of the body.

8. The toner cartridge of claim 6, wherein a phase of the holder located at the home position with respect to the rotation axis is the same as a phase of the discharge shutter located at the closed position with respect to the rotation axis.

9. A toner refilling interface structure including:

a toner cartridge including:

a body to accommodate toner and having a toner discharge portion;

a memory unit including an electrical contact portion including at least one electrical contact point; and a holder facilitating loading of the memory unit therein and being rotatable relative to the body between a home position and a rotated position;

a toner refilling portion to facilitate installation of the toner cartridge, the toner cartridge being rotatable to an installation position, a first angular position, and a second angular position; and a connecting portion to accommodate the holder to be rotatable relative to the body when the toner cartridge is installed at the toner refilling portion, the connecting portion including an electrical terminal portion to electrically connect to the electrical contact portion.

10. The toner refilling interface structure of claim 9, including an elastic member to apply an elastic force to the holder to be rotated in a direction to the home position from the rotated position.

11. The toner refilling interface structure of claim 10, including a rotation preventing unit to contact the holder to prevent the holder from being rotated beyond the home position.

12. The toner refilling interface structure of claim 11, wherein the home position corresponds to the installation position and the rotated position corresponds to the second angular position.

13. The toner refilling interface structure of claim 12, wherein the toner refilling portion includes:

an installation portion to facilitate rotatable installation of the toner cartridge;

a first toner inlet portion located in the installation portion and to receive toner from the toner cartridge;

an inlet shutter located in the installation portion, the inlet shutter being rotatable to an inflow position from a blocked position by a first rotation of the toner cartridge to the first angular position from the installation position, wherein the first toner inlet portion is blocked at the blocked position and the first toner inlet portion is open at the inflow position; and a rotation restricting portion to contact the inlet shutter to prevent the inlet shutter from being rotated beyond the inflow position.

14. The toner refilling interface structure of claim 13, wherein the toner cartridge includes;

a discharge shutter to be rotatable to a closed position and a discharge position, wherein the toner discharge portion is closed at the closed position and is open at the discharge position, and a locking member to lock the discharge shutter at the closed position, the inlet shutter includes a second toner inlet portion aligned with the first toner inlet portion at the inflow position of the inlet shutter to open the first toner inlet portion, the toner discharge portion protrudes outside of the body and is to insert into the second toner inlet portion, and a releasing portion is provided in the installation portion and, when the toner cartridge reaches the first angular position, the releasing portion interferes with the locking member to unlock the discharge shutter, wherein the discharge shutter is rotated to the discharge position from the closed position by a second rotation of the toner cartridge to the second angular position from the first angular position.

15. The toner refilling interface structure of claim 9, wherein a rotation axis of the holder with respect to the body is the same as a rotation axis of the toner cartridge with respect to the toner refilling portion.

* * * * *